OR 4,283,716 16.24

United Sta

Pasquali

4,283,716

Aug. 11, 1981

[54] MULTI-COLOR TRAFFIC SIGNAL

[75] Inventor: Giancarlo Pasquali, Bologna, Italy

[73] Assignee: CIR-S.p.A. Divisione Sasib, Bologna, Italy

[21] Appl. No.: 133,104

[22] Filed: Mar. 24, 1980

[51] Int. Cl.[3] ..... G08B 5/00

[52] U.S. Cl. ..... 340/380; 340/378.4

[58] Field of Search ..... 340/380, 47, 378.4

[56] References Cited

FOREIGN PATENT DOCUMENTS 1226855 3/1971 United Kingdom .

*Primary Examiner*—Harold I. Pitts

*Attorney, Agent, or Firm*—Spencer & Kaye

[57] ABSTRACT

A multi-color traffic signal in particular for railway line signalling installations, presents for each color a light source comprising a lamp, a collecting optical unit and a fixed chromatic filter. The light sources are connected by means of an optical fiber guide with an irradiating window surface constituting the output optics of the signal. The collecting optical unit comprises, arranged along a same optical axis and at opposite sides of the respective lamp, a curved focalized mirror and a spherical-elliptical lens, arranged so as to focalize the light flux of said lamp on the corresponding input of said optical fiber guide.

5 Claims, 5 Drawing Figures

MULTI-COLOR TRAFFIC SIGNAL

STATEMENT OF PRIOR ART

In accordance with 37 CFR 1.56 and 37 CFR 1.97, applicant submits herewith copy of the following prior art:

British Patent Specification No. 1 226 855 (Railroad Accessories Corporation): the whole document is of interest.

This art is the closest relevant prior art known to applicant.

BACKGROUND AND SUMMARY OF THE INVENTION

The invention relates to optical railway signals and in particular to those of the type called "searchlight signals" where a disc mask has at the center a circular window from which one or more sources of light, associated to a suitable optical unit, project, selectively on the basis of a control, one of a plurality of coloured lights, usually red, green and yellow.

In the oldest types of railway light signals, of the above specified type, there is provided a single light source or lamp with a respective optical unit which guides and projects a light beam through the window. Suitable chromatic filters are interposed between the lamp and the optical unit and the colors are changed by shifting the filters by mechanical means, electro-magnetically operated.

With the purpose of increasing the intensity of the color light emitted from the disc window, static signals have been introduced having a number of light sources corresponding to that of the signal colors desired. In this case, the device comprises, for each light source, an optical projector, which collects and projects a light beam emitted by the corresponding source, and this beam is taken in a respective light conducting system, or optical guide, which directs it to the signal exit window. The optical unit associated to each light source comprises also the respective chromatic filter, obviously fixed, while the window output unit consists generally of a non-spherical lens, as used, for instance, in the Italian Railways.

The above light conducting system, or optical guide, consists conveniently of bundles of optical fibers, which, starting from each respective light source, are brought to converge into a single beam, whose head is operatively aligned with the signal window.

This invention is aimed at improving the signal, in particular by improving the efficiency of the primary optical unit, or optical unit of collection of each chromatic light beam, and by increasing the brilliancy of the beam emerging from the output head, towards the signal window.

These and other features of the present invention and the resulting advantages, will be understood from the following detailed description of a preferred embodiment of same, given as a non restrictive example, with reference to the attached drawing.

DESCRIPTION OF THE PREFERRED EMBODIMENTS

Figure 2:
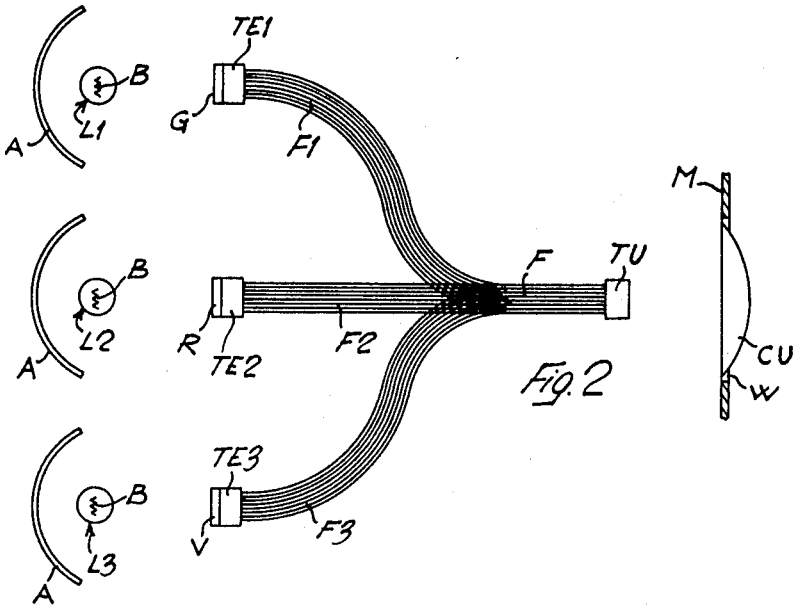
FIG. 2 is a diagrammatic view of a static signal presenting a light guide with three incoming optical fiber bundles and a single outgoing bundle.

By referring to the static searchlight signal, shown in FIG. 2, this signal consists essentially of three lamps, L1, L2, L3, whose respective filaments B are located in the focus of an equal number of concave spheric mirrors A. The heads TE1, TE2, TE3, of the respective optical fiber collecting bundles F1, F2, F3, receive the images of the filaments of the lamps, intended as punctiform sources, and the images reflected by the associated spheric mirrors A. At the input heads TE1, TE2, TE3, there are provided respectively the colour filters G (yellow), R (red) and V (green).

The collecting bundles F1, F2, F3 converge into a preferentially circular section single main bundle F in which the optical fibers of the three bundles are intermingled in a uniform manner, or anyhow according to any principle of regularity.

The output head TU of bundle F directs the outgoing light beam towards the aspherical lens CU, of the type used in the searchlight signal of the Italian Railways. This lens is fitted inside the window W of disk mask M for positioning the signal according to the desired direction of observation along a railway line.

In a static searchlight signal, with optical fiber bundle light conductors, this invention proposes the improvement hereinafter exposed.

Figure 1A:
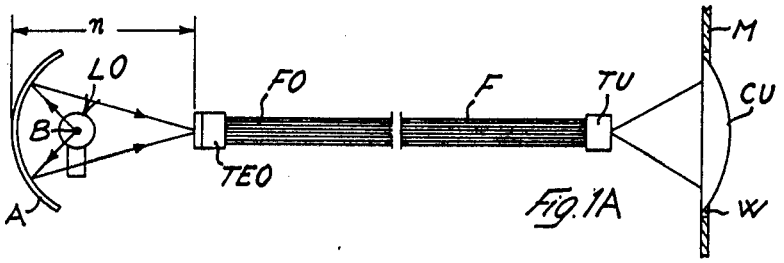
FIG. 1A is a diagrammatic view which illustrates a detail of a known-type static searchlight signal.

Referring to FIG. 1A, as for what concerns the input optical unit of the image to the single collecting bundles F0, the filament B of each a lamp L0 is arranged in a known manner, between the center and the reflecting surface of concave mirror A, in such a manner as to reproduce, by reflection, the image of the filament at the inputs TE0 of the light conducting bundles F0, after previous passage through the corresponding colour filter. The distance n is such that the image, generically rectangular, of the filament B produced by the mirror A is completely included in the input section of head TE0 of beam F0.

With the only provision of mirror A, preset as indicated in the previous paragraph, there is collected and conveyed in the light conductor only the part of the light flux which, from lamp B, is irradiated towards the mirror A, while, without any other artifice, the flux irradiated towards the input TE0 would be collected only in minimum part.

Figure 1:
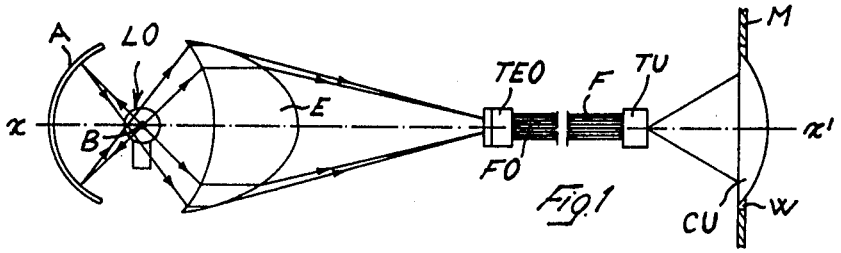
FIG. 1 is a diagrammatic view of a detail of the optical unit of a static searchlight signal, improved according to a feature of the present invention.

With the purpose of recovering in a substantially complete manner also the latter flux, the invention proposes the improvement consisting in the fact that a spherical-elliptical lens E is interposed between lamp B and each input TE0 (FIG. 1).

In this lens, the concave spheric-shaped surface is so realized that the light beams coming both directly from lamp B and indirectly reflected by mirror A, follow within the lens, a path parallel to the optical axis X—X', while the convex, elliptic-shaped surface of the lens conveys all the light beams by making them converge at the input TE0. Thus, the rectangular image of the filament B of lamp L0, collected at the input TE0 of each respective bundle branch F0, is much brighter, that is, of greater brilliancy or specific light intensity.

Figure 3:
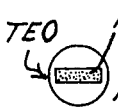
FIG. 3 is a diagrammatic front view of any of the input heads TE0, of the light guide with optical fiber bundles F0, and of the light image formed on it by the input optical unit referred to in FIG. 1.

With a rectangular image of the filaments B on inputs TE0 of light conducting bundles F0, the distribution of the elementary optical fibers in these bundles, at the input head TE0, is arranged so as to assume the corresponding rectangular shape P, indicated in the detail of FIG. 3.

Figure 4:
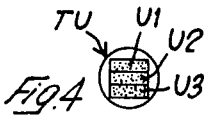
FIG. 4 is a front view of the same guide from the side of output head TU this figure showing a superposed rectangular arrangement of the optical fibers of the above bundles, according to a feature of the invention.

According to another main feature of the present invention the distribution and the mingling of the elementary optical fibers, or of the small bundles at the common output head TU, is accomplished in such a manner as to have at the end, that is, at the output, three distinct superimposed rectangular layers U1, U2, U3 (see FIG. 4). Alternatively, the configuration shown in FIG. 5 can be obtained with only one central circular area RS occupied by elementary filaments of only one of the three types F1, F2, F3 and preferably the filaments of the bundle associated to the red light optical unit; and a circular crown area GV, formed by a uniform mingling of the filaments of the two remaining types, those relating to the green light optical unit and to the yellow light optical unit.

Figure 5:
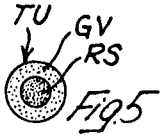
FIG. 5 is a view, similar to FIG. 4, with a concentric arrangement, with a double combination of the fibers of the bundles, according to a further feature of the invention.

The output configuration shown in FIG. 4 has the purpose of obtaining the maximum specific light intensity, or brilliancy, of the image transmitted by the input optical unit preset in a uniform manner for all the three colours, or aspects, of the signal lights; while the output configuration of FIG. 5 has the purpose of obtaining the maximum brilliancy in the central area RS, from which the red light emerges. In this case, the remaining colours, green and yellow, will have brilliancies equivalent to each other, but lower than the red one.

In the alternative solution of FIG. 5, the light conductor or optical fiber bundle which goes into the central circle RS, could consist of a single fiber or optical guide, instead of a bundle of elementary fibers.

It will be observed that the final optical unit, or output optical unit, consists of a non spherical (aspherical) lens, of the type normally applied to the static search-light signal used by the Italian Railways. Furthermore lamps L1, L2, L3 are not of the projector type.

It is understood, that this invention is not restricted to the embodiments which have been described as an example but could be broadly varied and modified, mainly from the constructive point of view, without, however, departing from the broadest limit of the principle of the invention, as described above and claimed hereafter.

I claim:

1. Multi-color traffic signal in particular for railway line signalling installations, of the type presenting for each color a light source comprising a lamp, a collecting optical unit and a fixed chromatic filter, the light sources being connected by means of a optical fiber guide with an irradiating window surface constituting the output optics of the signal, characterized by the fact that said collecting optical unit comprises, arranged along a same optical axis and at opposite sides of the respective lamp, a curved focalized mirror and a spherical-elliptical lens, arranged so as to focalize the light flux emanating directly from said lamp and the flux reflected from said mirror on the corresponding input of said optical fiber guide.

2. Multi-color signal according to claim 1, in which the light conducting optical fiber guide comprises as many optical fiber bundles as the number of light sources, these bundles having a separate input, onto which the said spherical-elliptical lens focalizes a substantially rectangular image of the corresponding light source, and a common output, in the area of which the elementary optical fibers of each bundle are uniformly distributed within respective contours, each contour containing terminals of fibers of a single bundle.

3. Multi-color signal according to claim 2, in which said contours at the output are rectangular and adjacent.

4. Multi-color signal according to claim 2, in which said contours comprise a circular crown, and the circle enclosed in it, said circle containing the terminal of the bundle correlated with the red colored light input, while the circular crown comprises, uniformly intermingled between each other, the respective terminals of the fibers of the beams corresponding to the green and yellow lights.

5. Multi-color signal according to claim 4, in which the light guide for the red light consists of one single circular-section optical fiber, having a diameter equal to the inner diameter of the circular crown.

* * * * *